United States Patent [19]

Teresi et al.

[11] Patent Number: 4,936,008

[45] Date of Patent: Jun. 26, 1990

[54] LASER STRIPING METHOD FOR ASSEMBLING TWT

[75] Inventors: Joseph A. Teresi, Saratoga; Marshall B. McDonald, Palo Alto, both of Calif.

[73] Assignee: Teledyne Mec, Mountain View, Calif.

[21] Appl. No.: 373,661

[22] Filed: Jun. 27, 1989

Related U.S. Application Data

[63] Continuation of Ser. No. 191,928, May 9, 1988, abandoned.

[51] Int. Cl.[5] ..... H01P 11/00

[52] U.S. Cl. ..... 29/600; 29/447; 72/342.94; 219/121.85

[58] Field of Search ..... 29/600, 447; 219/121.85, 121.6; 72/342; 315/3.5

[56] References Cited

U.S. PATENT DOCUMENTS

| | | | |
|---|---|---|---|
| 2,706,366 | 4/1955 | Best | 29/600 X |
| 3,260,875 | 7/1966 | Evans | 29/447 X |
| 3,300,677 | 1/1967 | Karol et al. | 29/600 X |
| 3,310,864 | 3/1967 | MacKerrow | 29/600 X |
| 3,624,678 | 11/1971 | Falce | 29/600 |
| 3,748,729 | 7/1973 | Bottcher et al. | 29/600 |
| 4,270,069 | 5/1981 | Wiehler | 315/3.5 |
| 4,304,978 | 12/1981 | Saunders | 219/121.85 X |
| 4,625,533 | 12/1986 | Okada et al. | 72/342 X |
| 4,727,641 | 3/1988 | Kanatani et al. | 29/447 |

FOREIGN PATENT DOCUMENTS

| | | | |
|---|---|---|---|
| 61-99629 | 5/1986 | Japan | 219/121.85 |
| 984607 | 2/1965 | United Kingdom | 29/600 |

*Primary Examiner*—Carl J. Arbes

*Attorney, Agent, or Firm*—Townsend and Townsend

[57] ABSTRACT

An improved method for assembling a travelling wave tube (TWT) including the step of forming a heat stripe along the barrel of the TWT to reduce the diameter of the barrel and create an interference fit between the barrel and internal components of the TWT.

8 Claims, 2 Drawing Sheets

10
12
14
16
17

LASER STRIPING METHOD FOR ASSEMBLING TWT

This is a continuation Ser. No. 191,928 filed May 9, 1988 now abandoned.

BACKGROUND OF THE INVENTION

1. Field of the Invention

The present invention relates generally to assembly methods and, more particularly, relates to a method for assembling a high-frequency travelling wave tube (TWT).

2. Description of the Prior Art

FIG. 1A is an exploded view of a partial disassembled travelling wave tube and FIG. 1B is a cutaway view of an assembled TWT. The figures illustrate a circuit assembly of only a portion of TWT 10. Referring to FIG. 1A. the TWT 10 includes a barrel 12 into which a helix 14 and rods 16 are inserted. The dimensions of the barrel 12, helix 14, and rods 16 are selected so that when the TWT is assembled the barrel exerts pressure on the rods 16 directly and the helix 14 indirectly via the rods 16 to maintain the position of the various parts as shown in FIG. 1B. The pressure is exerted because the combined diameter of the helix/rod assembly is greater than the inside diameter of the barrel 12. This relationship between the diameter of the workpiece to be inserted and the inside diameter is known as an interference fit.

FIG. 2 is an example of a prior art method for assembling a TWT 10. As is apparent from the above description, special provisions must be made to accomplish an interference fit because the diameter of the piece to be inserted is larger than the inside diameter of the barrel 12. In FIG. 2, a set of blades 20 is utilized to deform the barrel 12 to allow the insertion of the helix/rod assembly 17, not labelled in FIG. 2. As shown, the barrel diameter increases between the blades and the rods 16 are oriented to be inserted into these regions of increased diameter. After the helix/rod assembly 17 has been inserted into the barrel 12, the pressure from the blades 20 is released and the barrel 12 returns to approximately its original shape. Accordingly, pressure is exerted on the rods 16 and an interference fit is effected.

There are several problems associated with this prior art method of TWT assembly. First, complicated tooling is required to practice the method. The blade assembly for distorting the barrel 12 is a specialized precision tool and a special fixture is needed for preassembling the helix and rods and inserting the assembly 17 into the barrel 12. Secondly, the degree of the interference fit, i.e., the difference between twice the radius of the piece to be inserted to the inner diameter of the barrel, is limited, As a result, the pressure that may be exerted on the helix/rod assembly 17 by the barrel 12 is limited. Since rods 16 are scraped against barrel 12 to obtain a maximum interference fit without overly deforming the barrel, this method of insertion may cause cracking or breaking of the rods 16. Further, variations in part sizes within tightly specified tolerances cause relatively large variations in interference fit pressures, adversely affecting uniformity of the assembly. The performance of the device is adversely affected by these variations in pressure, particularly pressures below a threshold level. The prior art does not ensure a pressure above the threshold pressure for each assembly.

It is believed that poor contact between the rods 16 and the inside of the barrel 12 reduces heat transmission from the helix to the barrel 12 via the rods 16. Also, it is believed that cracking of the rods 16 causes pulse breakup and other problems during operation of the TWT 10. Further, in some cases, the tool used for inserting the helix/rods assembly requires the rods 16 and helix 14 to be glued to a mandrel. This glue is later removed utilizing alcohol, which tends to absorb water. During operation of the TWT 10. this water may cause contamination of the TWT cathode.

Accordingly. a method of assembling a TWT that requires less tooling, that increases the degree of the interference fit, can control and produce greater, more uniform pressure, and reduces the cracking or breaking of the rods during insertion would be of great benefit to the art.

SUMMARY OF THE INVENTION

The present invention is a method of assembling a TWT and creating an interference fit between the barrel of the TWT and the helix/rod assembly that does not require mechanical distortion of the barrel during insertion of the helix/rod assembly into the barrel.

In a preferred embodiment, the diameter of the helix/rod assembly is less than the inner diameter of the barrel. The helix/rod assembly is inserted into the barrel to form a slip fit. A laser beam is utilized to form an axially oriented heat stripe, preferably three heat stripes, along the surface of the barrel. The barrel material along the heat stripe expands, deforms, then contracts upon cooling and causes the overall diameter of the barrel to decrease to create an interference fit between the barrel and the helix/rod assembly. The diameter change resulting from each heat stripe is cumulative. Additionally, the length of the barrel is slightly decreased.

According to one aspect of the invention, the energy incident on the barrel is controlled so that the barrel material is locally heated, melts or otherwise plastically deforms to form a laser stripe along the surface of the barrel. Upon cooling, the diameter of the barrel is reduced and its thickness is increased at the locations of the stripes, thus reducing the material available elsewhere.

The barrel may be either melted or heated beyond its yield point. In either case, a portion of the heated material expands thermally and deforms resulting in a thicker region which causes the overall diameter of the barrel to decrease.

In one embodiment, the rods are oriented about the helix so that the angular displacements between the rods are equal. The stripes are formed between pairs of rods and positioned equidistantly from the rods in each pair.

In an alternate embodiment, additional or incremental shrinking of the barrel can be accomplished by repeatedly striping the barrel at the same locations or by making parallel symmetrical stripes between the rods. In addition, external restraint may be applied to the barrel while striping to enhance the shrinking action. In a preferred embodiment, the stripes are symmetrical because symmetrical pressure is desired. This method can also be adapted to produce asymmetrical stresses.

According to a still further aspect of the invention, other sources of energy, which can produce a small heat affected zone such as an electron beam, may be utilized to form the heat stripes along the surface of the barrel. Since laser striping can cause a barrel to shrink considerably more than is practical for interference, part tolerances may be looser and still assure adequate pressure.

Other features and advantages of the invention will become apparent in view of the drawings and following detailed description.

DETAILED DESCRIPTION OF THE PREFERRED EMBODIMENTS

Figure 3:
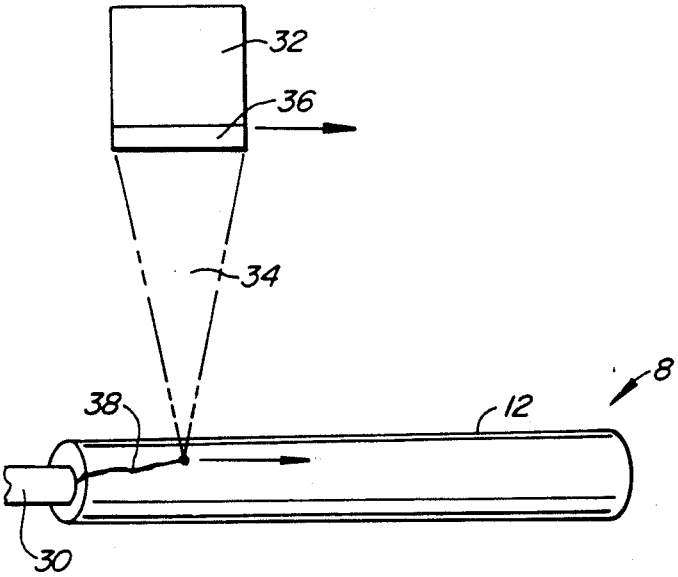
FIG. 3 is a schematic diagram of an apparatus utilized to practice the invention.

FIG. 3 is a schematic diagram illustrating an apparatus utilized for practicing a preferred embodiment of the invention. Referring now to FIG. 3. a fixture 30 is utilized to maintain the relative positions of the rods and helix, not shown in FIG. 3, while they are slip fitted into the barrel 12. In this embodiment, the diameter of the rods/helix assembly is less than the inner diameter of the barrel 12. Thus, the rods/helix assembly is easily slip fitted into the barrel 12 and no glue is required since there is essentially no sliding force between the rods and the barrel. Accordingly, the cathode contamination problem described above is obviated.

A laser 32 generates a beam 34 which is directed onto the surface of the barrel 12 by a lens system 36. The power of laser beam 34 is distributed along the outer surface of barrel 12. A first positioning system (not shown) moves the laser 32 in the longitudinal direction to form a heat stripe 38 along the barrel 12. The laser or other heat source may be either pulsed or continuous. Additionally, a second positioning system (not shown) rotates the barrel by a selected angular displacement. In practice, the position of the heat stripe 38 on the barrel relative to the positions of the rods is controlled by the first and second positioning means. Stripes 38 may be applied one at a time, as herein described, or, alternatively, stripes 38 may be applied simultaneously.

Figure 4:
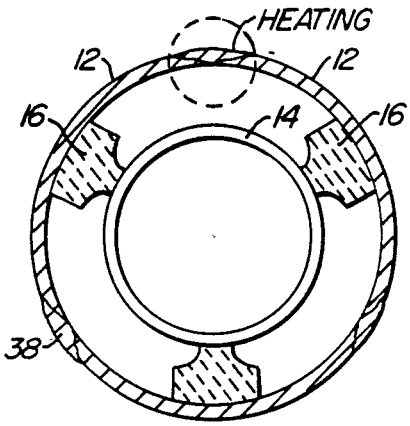
FIG. 4 is a cross-sectional view of a TWT assembled according to an embodiment of the invention.

FIG. 4 is a cross sectional view of a TWT 10 assembled utilizing a preferred embodiment of the invention. In FIG. 4, the three T-shaped rods 16 are oriented so that the angular displacements between the rods 16 are equal. Three heat stripes 38 are formed. either sequentially or simultaneously with each stripe 38 positioned between a pair of rods 16 and equidistant from the rods in the pair.

Referring now to a particular heat stripe. e.g.. stripe A at the top of FIG. 4. the energy and sweep rate of the laser beam 34, as seen in FIG. 3, is controlled to control the energy incident on the heat stripe 38 formed along the surface of the barrel 12. The magnitude of this energy is selected so that a selected thickness of the barrel 12 melts and/or plastically deforms as the beam 34 moves along the barrel 12. After the laser beam 34 is removed from that local area. a trail of plastically deformed solidified material, i.e., a laser stripe, is formed along the surface of the barrel 12.

The localized heating and cooling that forms the laser stripe along the surface of the barrel causes the diameter of the barrel 12 to decrease and the length of the barrel 12 to slightly decrease. The degree of decrease increases with the number of laser stripes formed and with the depth of the laser stripe. Thus, the method described herein provides for control of degree of the interference fit between the helix/rod assembly 17 and the barrel 12.

In one embodiment, the barrel is formed of 304 stainless steel. The formation of a laser stripe affects the grain structure of metal and changes the properties of the metal. One possible drawback to the method described is to reduce the capacity of the barrel to maintain the vacuum required for operation of the TWT 10. However, for this material it has been determined that the tube retains its ability to maintain a vacuum.

The placement of the stripes as depicted in FIG. 4 appear to result in improved contact between the rods 16 and barrel 12 thereby improving heat transfer.

Figures 1A, 1B:
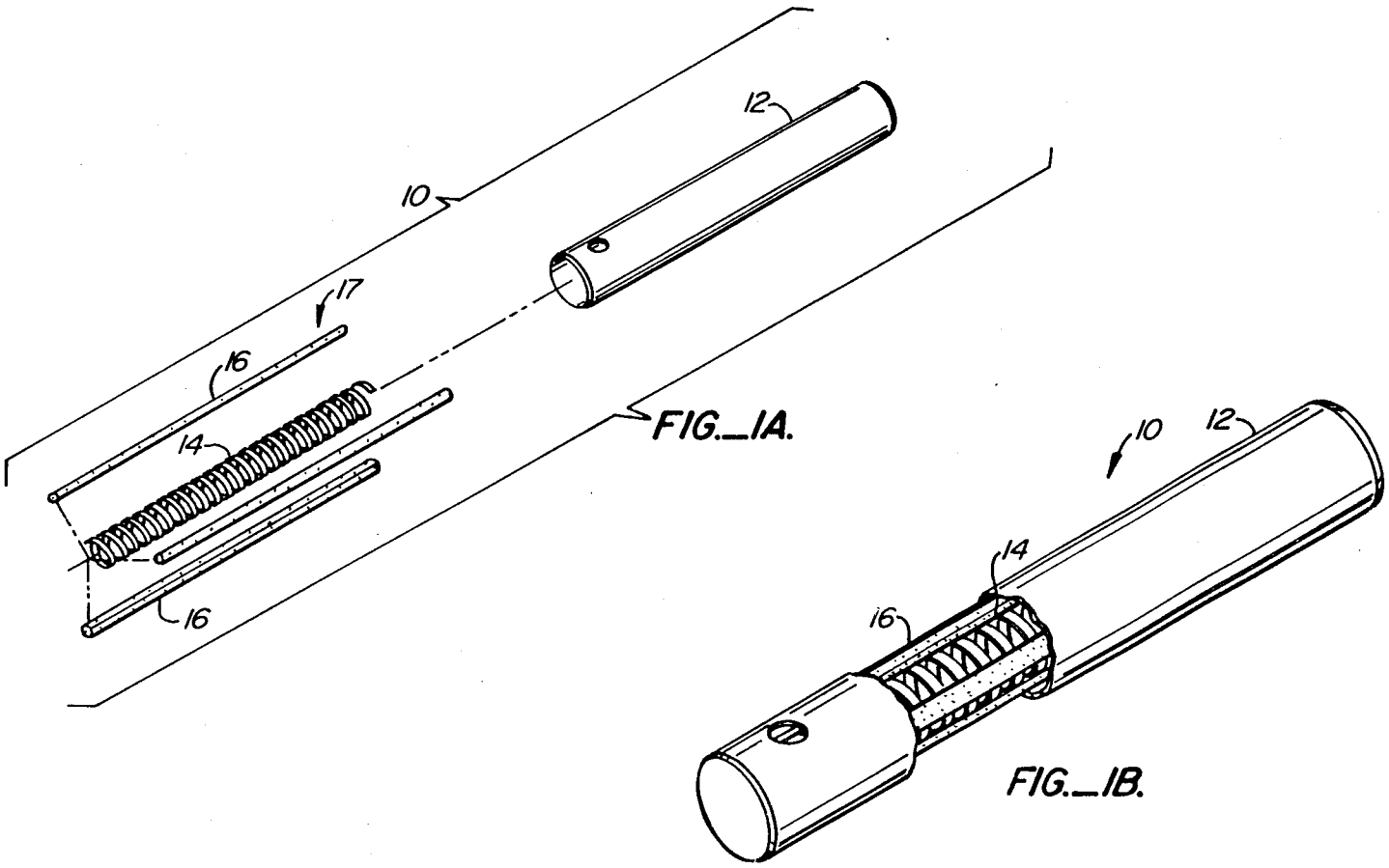
FIG. 1 is an exploded view of a TWT.
Figure 2:
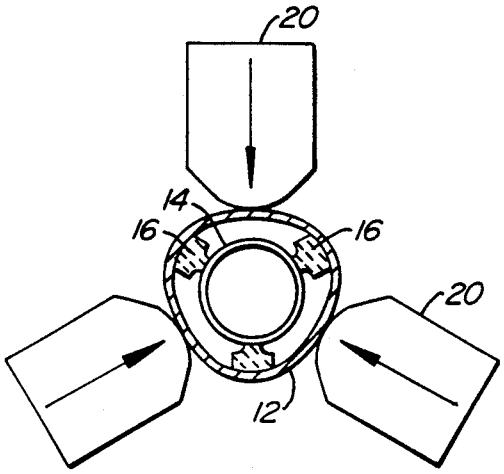
FIG. 2 is a cutaway view of a TWT.

A significant advantage of the invention is the ability to create or increase the degree of an interference fit at a selected point of the assembly process. For example, the TWT 10 could be assembled as described above with reference to FIG. 2. The present laser striping procedure is then utilized to increase the degree of the interference fit. It has also been discovered that the laser striping method can also be utilized to repair TWTs having certain operational problems. Using the laser striping method to reduce the diameter of the barrel 12 can cause a defective TWT again to become operative. By regulating the length and location of the stripes, certain sections of the barrel can be preferentially shrunk. For example, the end of the output section of the slow wave structure can be striped to improve heat transfer in this thermally critical region. In addition to improving heat transfer, the higher pressure which can be assured by laser striping will obviate certain performance problems.

Although a laser beam has been utilized to form the heat stripes in the above-described preferred embodiments, other methods for forming the stripes are within the scope of the invention. For example, an electron beam could be utilized. Further, the number of stripes and placement of stripes can be varied as required. A circumferential stripe can produce a smaller barrel diameter at a particular axial location. Other variations and substitutions will now be obvious to persons of ordinary skill in the art. Additionally, it is not necessary to melt the barrel material along the heat stripe to reduce the diameter of the barrel. However, in order for the material, such as the barrel, to be purposely deformed, it must be heated. Specifically, for a given heat source and heat sinking, the thermal diffusivity of the material to be deformed must be sufficiently low to produce a sharp thermal gradient. The laser on a thin stainless steel barrel is satisfactory for this purpose. Accordingly, the invention is not intended to be limited except as provided by the appended claims.

What is claimed is:

1. A method for assembling, a travelling wave tube of the type including a barrel, a helix positioned inside the barrel, and a plurality of longitudinal rods, oriented lengthwise along the barrel and disposed between the helix and the barrel, with the rods for positioning the helix within the barrel and for conducting heat from the helix to the barrel during operation of the travelling wave tube, said method comprising the steps of:

inserting the helix and rods into the barrel with the rods positioned between the helix and the barrel and oriented along the length of the barrel;

providing a variable powered laser beam:

directing the power of said laser beam onto the outer surface of the barrel; and distributing the power of the laser beam along the outer surface of the barrel to form a heat stripe that reduces the diameter of the barrel and creates an interference fit between the helix, rods, and barrel.

2. The method of claim 1 wherein said step of inserting further comprises the step of:

positioning the rods about the helix so that the angular displacements between the rods are substantially equal;

and wherein said assembly method further comprises the steps of:

selecting a pair of adjacent rods in said plurality of rods; and position-ing heat stripe between said selected pair of adjacent rods and substantially equidistant from each of the rods in said selected pair.

3. The method of assembling a travelling wave tube as defined by claim 1 wherein the step of inserting the helix and rods into the barrel comprises the step of slip fitting the helix and rods into the barrel.

4. The method for assembling a travelling wave tube as defined by claim 1 wherein the step of moving the focused laser along the outer surface of the barrel includes moving the laser in an axial direction along the barrel.

5. The method for assembling a travelling wave tube as defined by claim 1 wherein the step of distributing the power of the laser beam includes moving the laser beam along the barrel.

6. A method for assembling a travelling wave tube of the type including a barrel, a helix positioned inside the barrel, and a plurality of longitudinal rods, oriented lengthwise along the barrel and disposed between the helix and the barrel, with the rods for positioning the helix within the barrel and for conducting heat from the helix to the barrel during operation of the travelling wave tube, said method comprising the steps of:

inserting the helix and rods into the barrel with the rods positioned between the helix and the barrel and oriented along the length of the barrel; and heating a stripe along the outside of the barrel to a sufficient temperature to cause deformation of the barrel along the heat stripe thereby reducing the diameter of the barrel and creating an interference fit between the helix, rods, and barrel.

7. The method of claim 6 wherein said step of inserting further comprises the step of positioning the rods about the helix so that the angular displacements between the rods are substantially equal: and wherein said assembly method further comprises the steps of:

selecting a pair of adjacent rods in said plurality of rods; and positioning said heat stripe between said selected pair of adjacent rods and substantially equidistant from each of the rods in said selected pair.

8. The method for assembling a travelling wave tube as defined by claim 6 wherein the step of heating a stripe along the outside of the barrel includes sequentially heating stripes along the outside of the barrel to form a plurality of heat stripes.

* * * * *